United States Patent [19]

Bailey

[11] 4,209,958

[45] Jul. 1, 1980

[54] ARTICLE STRAPPING

[76] Inventor: Peter E. Bailey, 6, Broadwater Dr., Saratoga, New South Wales, Australia

[21] Appl. No.: 946,001

[22] Filed: Sep. 26, 1978

[30] Foreign Application Priority Data

Oct. 10, 1977 [AU] Australia ..... 1997/77

[51] Int. Cl.[2] ..... B65B 9/02; B65B 11/08

[52] U.S. Cl. ..... 53/553; 53/228; 53/373; 53/586

[58] Field of Search ..... 53/399, 450, 466, 553, 53/586, 228, 229, 373

[56] References Cited

U.S. PATENT DOCUMENTS

| | | | |
|---|---|---|---|
| 2,741,885 | 4/1956 | Allison | 53/586 |
| 3,672,116 | 6/1972 | Ingmarson | 53/229 X |
| 3,950,203 | 4/1976 | Van der Wal | 53/586 X |

FOREIGN PATENT DOCUMENTS

| | | | |
|---|---|---|---|
| 2548786 | 5/1977 | Fed. Rep. of Germany | 53/553 |
| 1297000 | 11/1972 | United Kingdom | 53/228 |

*Primary Examiner*—John Sipos

*Attorney, Agent, or Firm*—Ladas & Parry

[57] ABSTRACT

An apparatus for use in strapping a bundle of articles with a heat sealable plastics material strap, the apparatus having first and second strap feed stations and a support for receiving and supporting a bundle of articles to be strapped. When the bundle is moved onto the support it passes through the line of the strap extending between the stations so that the strap is caused to embrace the bundle, and first and second limbs of the strap which then extend from the bundle to the respective stations are each clamped at two spaced apart zones. The two strap limbs are then severed between the clamping zones by a reciprocating cutter and resultant corresponding end portions of the severed limbs are then moved into clamping contact and welded together in overlapping relationship.

10 Claims, 19 Drawing Figures

ARTICLE STRAPPING

FIELD OF THE INVENTION

This invention relates to a method of and apparatus for strapping an article with a heat sealable plastics material strap, the term "article" being used herein to denote either a single element or a bundle of elements which are to be strapped together.

BACKGROUND OF THE INVENTION

An automated strapping operation is usually performed at the tail end of a production line, where produced elements are strapped together or are loaded in some sort of retainer and the retainer strapped. Machines which currently are employed for such automatic strapping operation are well known, but equally well known is their inherent complexity. The present invention seeks to avoid or, at least, reduce the problems of prior art machines by providing for a relatively simple strapping cycle which facilitates high speed operation.

DESCRIPTION OF PRIOR ART

U.S. Pat. No. 3950203, granted Auke Van der Wal and assigned to Vereenigde Metaalverpakking en Hechtdraad Industrie B.V. MVM-Endra, discloses a method and apparatus of a type to which the present invention relates. The referenced patent is directed particularly toward the strapping of articles with a tape material of a type which may be glued, although the patent specification does additionally suggest the use of fusible material tapes.

In the context of strapping articles with fusible material tapes, the referenced U.S. patent suggests that spot welding electrodes or other heating electrodes may be inserted into a space which is bounded by tape strainer and stop member portions of the strapping apparatus. However, the referenced patent makes no disclosure as to the manner in which the suggested electrodes might be constructed, positioned or operated to impart effective heating to tape portions to be joined without, at the same time, interferring with the tape strainer portions or with a cutter associated with the strainer portions.

The present invention is directed specifically to the strapping of articles with a heat sealable plastics material tape and it provides an apparatus which may be employed to effect heat sealing of overlapped end portions of the tape.

SUMMARY OF THE INVENTION

The present invention may be defined as providing a method of strapping an article with a heat sealable plastics material strap, the method comprising the steps of:

(a) extending the strap between spaced-apart first and second stations, one at least of which being a strap feed station, (b) moving the article through the path of the strap whereby the strap is caused to embrace a portion of the article's periphery with first and second limbs respectively of the strap extending from the article toward the first and second stations, (c) clamping the strap at two spaced-apart zones along each limb thereof, (d) severing the first and the second limbs of the strap at a point between the clamping zones of the respective limbs, to produce adjacent, separate, end portions in each limb, and (e) moving corresponding said end portions of each limb into engagement and welding such end portions whereby one section of the tape length is caused to again extend between the first and second stations while the other section of the tape length is caused to completely embrace the article.

The invention further provides an apparatus for strapping an article with a heat sealable plastics material strap, the apparatus comprising:

(a) spaced-apart first and second strap stations arranged to support opposite end portions of the strap, one at least of said stations being a strap feed station, (b) support means for receiving and supporting the article to be strapped and disposed such that, in operation of the apparatus, the strap embraces a portion of the periphery of the article when supported upon the support means with first and second limbs of the strap extending toward the first and second stations respectively, (c) clamping means disposed and actuable to clamp each of the first and second strap limbs at spaced-apart zones, (d) severing means actuable in operation of the apparatus to sever both the first and second limbs of the strap at a point between the clamping means acting on each strap limb, and (e) displacing/heat sealing means actuable to move corresponding said end portions of the respective limbs of the strap between the clamping means into clamping/heat sealing contact.

The invention will be more fully understood from the following description of a preferred embodiment of a strapping machine which is suitable for strapping successive bundles of knocked-down cardboard cartons. The description is given by way of example only and with reference to the accompanying drawings which are in part schematic and which are not intended to be limiting on the invention.

DESCRIPTION OF PREFERRED EMBODIMENT

Figure 1:
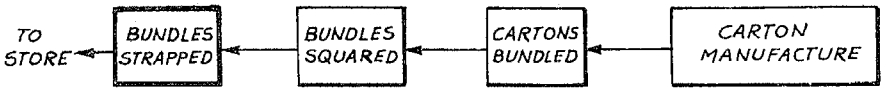
FIG. 1 shows a typical sequence of events leading to strapping of a bundle of knocked-down cartons.

The strapping machine to be described may typically be used for strapping bundles of cardboard cartons. As indicated in FIG. 1, following a manufacturing stage, the cartons in a knocked-down state are automatically stacked in bundles, with a predetermined number of cartons (say ten) in each bundle. The bundles are then "squared" so as to present a neat package and the bundles are strapped one after another.

The present invention is concerned solely with the bundle strapping aspect of FIG. 1, but it is to be understood that the bundle strapping machine may in fact be formed as a part of or be ancillary to upstream machinery.

Figure 3:
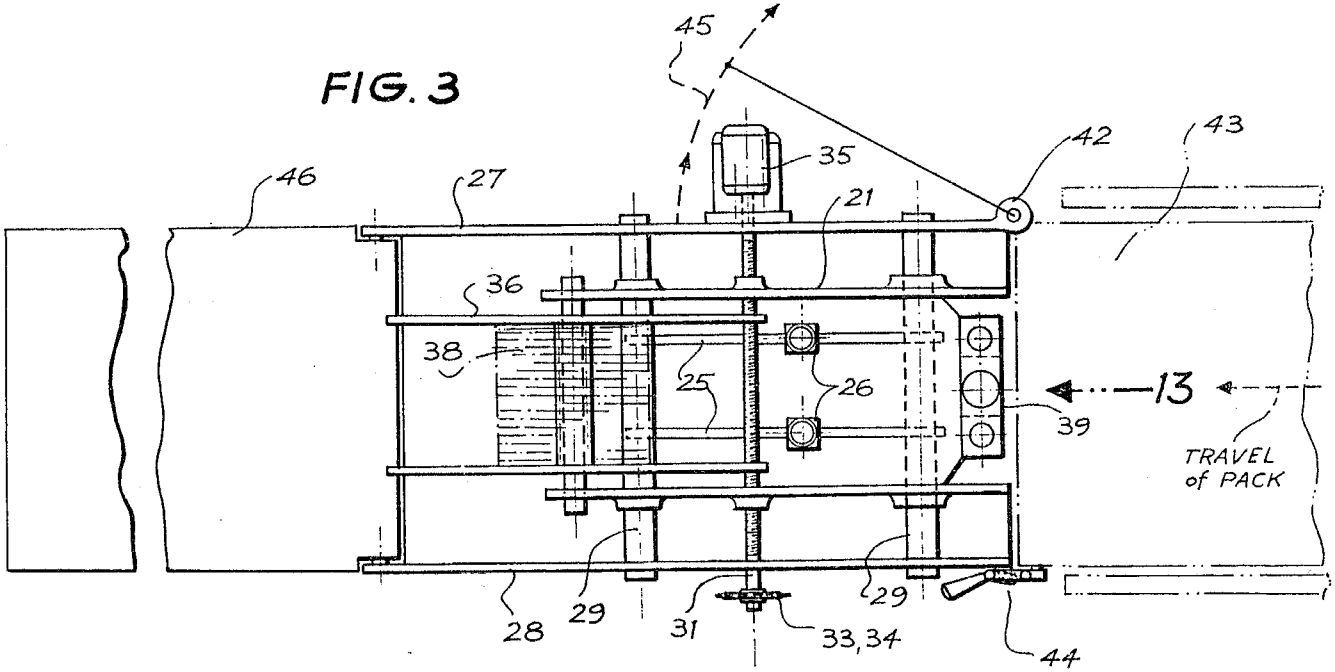
FIG. 3 shows a plan view of the strapping machine as viewed in the direction of the arrow designated by numeral 3 in FIG. 2, FIGS. 4 to 11 show sequential operating steps performed by top and bottom clamping/severing/sealing heads of the strapping machine.
Figure 2:
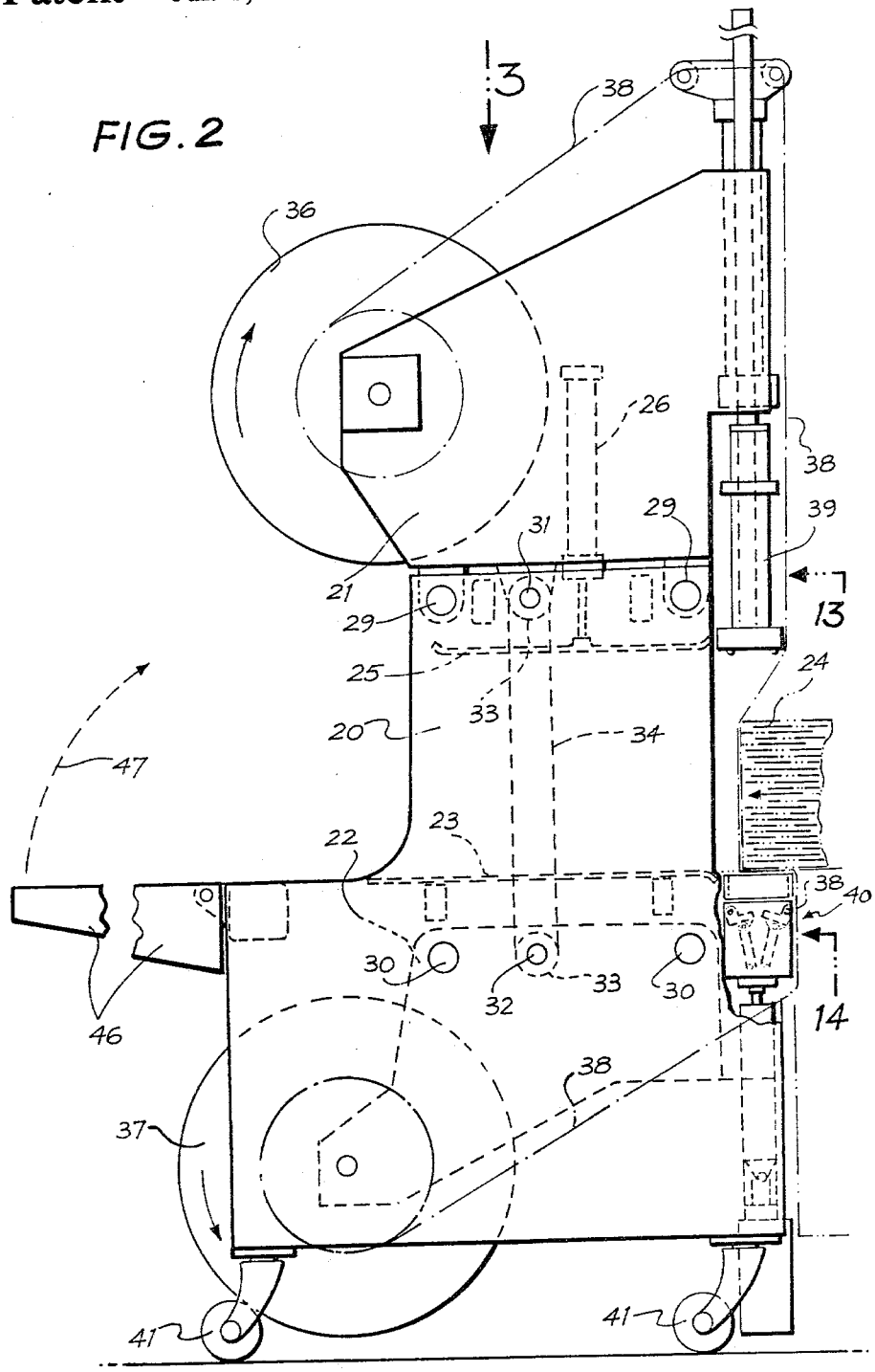
FIG. 2 shows a side elevation view of the strapping machine.

The bundle strapping machine is shown in FIGS. 2 and 3 and it comprises a main frame 20. This frame supports upper and lower sub-frames 21 and 22 and it includes a table or support surface 23 which is arranged to support a bundle 24 to be strapped. The bundle 24 to be strapped is pushed into the righthand side of the machine by a pusher (not shown) associated with a preceding bundle squaring machine and, after strapping, the bundle is removed from the lefthand side of the machine.

During the strapping operation, the bundle 24 is held in place on the support surface 23 by ram-actuated feet 25 which are mounted via ram cylinders 26 to the upper subframe 21.

The upper and lower sub-frames 21 and 22 are supported between side walls 27 and 28 (FIG. 3) of the main frame 20 by horizontal transversely extending upper and lower pairs of shafts 29 and 30 respectively. The upper sub-frame 21 is slidable along the shafts 29 and the lower sub-frame 22 is slidable along the shafts 30.

Upper and lower lead screws 31 and 32 also extend between the side walls 27 and 28, and the respective lead screws engage in threaded collar elements (not shown) associated with the upper and lower sub-frames 21 and 22 respectively. The two lead screws are interconnected by way of sprockets 33 and a chain drive 34 and are coupled to a geared motor 35 which, when energized, functions to drive the sub-frames 21 and 22 back or forth in a transverse direction (i.e. into or out of the paper containing FIG. 2). With this arrangement the position of the banding strap relative to the width of the bundle may be varied.

The sub-frames 21 and 22 respectively carry upper and lower strap feed stations, including strap feed spools 36 and 37. A strap 38 of any desired heat sealable plastics material (e.g. polypropylene) and of a required width, or a number of parallel straps of such material, extends between the spools 36 and 37 and down the front (leading) face of the machine.

Upper and lower clamping/severing/sealing heads 39 and 40 are mounted to the upper and lower sub-frames 21 and 22 respectively. The function and operation of such heads being hereinafter described with reference to FIGS. 4 to 11 and then, in greater detail, with reference to FIGS. 12 to 17.

The main frame 20 is carried by ground engaging wheels 41 and it incorporates a hinge 42 (see FIG. 3) whereby the strapping machine may be connected to a preceding piece of machinery 43, such as a bundle squaring machine. A latching mechanism 44 is also provided on the main frame, on the side opposite the hinge, so that the strapping machine may be positively locked to the preceding machine 43. The hinge mounting 42, latch 44 and ground engaging wheels 41 are provided to enable the strapping machine to be pivoted away from the preceding machine, in the direction of arrow 45, so that servicing and maintenance work can be performed conveniently on the clamping/severing-/sealing heads 39 and 40.

Also, because a following piece of machinery such as a bundle take-off conveyor (not shown) would normally be located against the rear (trailing) end of the strapping machine, a pivotable out-feed table 46 is hinge mounted to the main frame. This table is pivoted upwardly, in the direction of arrow 47, when the strapping machine is to be pivoted away from the preceding machine 43.

The working inter-relationship of the clamping/severing/ sealing heads 39 and 40 is now described, in the context of a bundle strapping operation, with reference to FIGS. 4 to 11 of the drawings. However, before proceeding with the description it should be mentioned that these Figures are largely schematic and that the actual arrangements of parts which constitute the heads are shown in FIGS. 12 to 17, to which later reference will be made.

Figure 4:
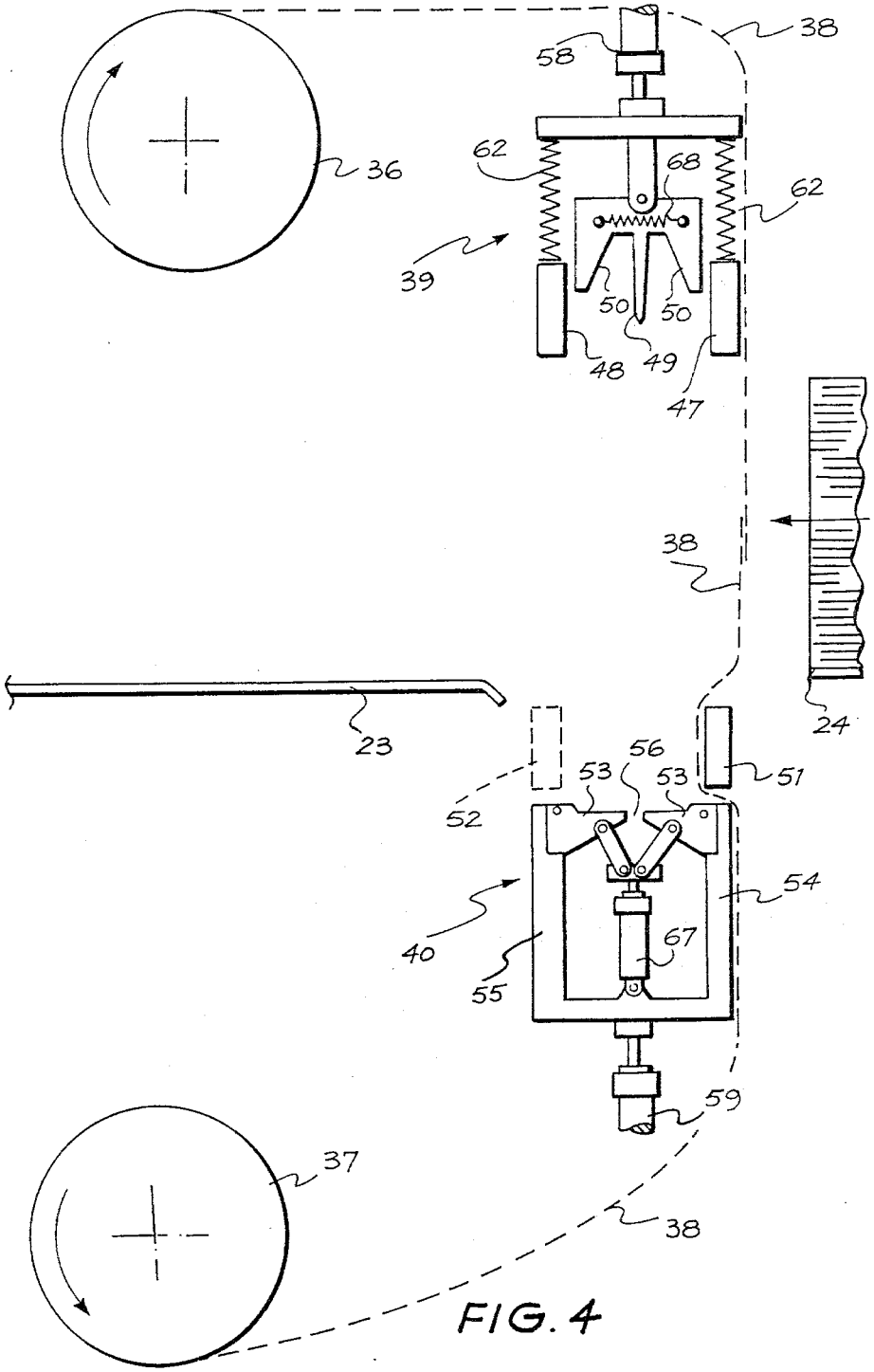

FIG. 4 shows the salient elements of the upper and lower heads 39 and 40, together with the strap spools 36 and 37, the strap 38 extending between the spools, the bundle support table 23 and an unstrapped bundle 24 about to enter the machine. The upper head 39 includes spaced-apart clamp elements 47 and 48, a strap severing blade 49 and heater bars 50. The lower head 40 includes a first clamp element 51, a laterally displaceable second clamp element 52, and pivot fingers 53 mounted to further, third and fourth, clamping elements 54 and 55. The clamp elements 47, 48 align with the elements 51, 52 and 54, 55, and the severing blade 49 aligns with a gap 56 between the two fingers 53.

It is important to note that the strap 38, in extending between the two spools 36 and 37, passes behind the first clamp element 51 of the lower head 40. It is also to be noted that, prior to the bundle 24 entering the strapping machine, the second clamp element 52 is displaced laterally with respect to the direction of movement of the bundle 24. Thus, the second clamp element 52 is displaced in a direction out of the plane of the paper containing FIG. 4.

Figure 5:
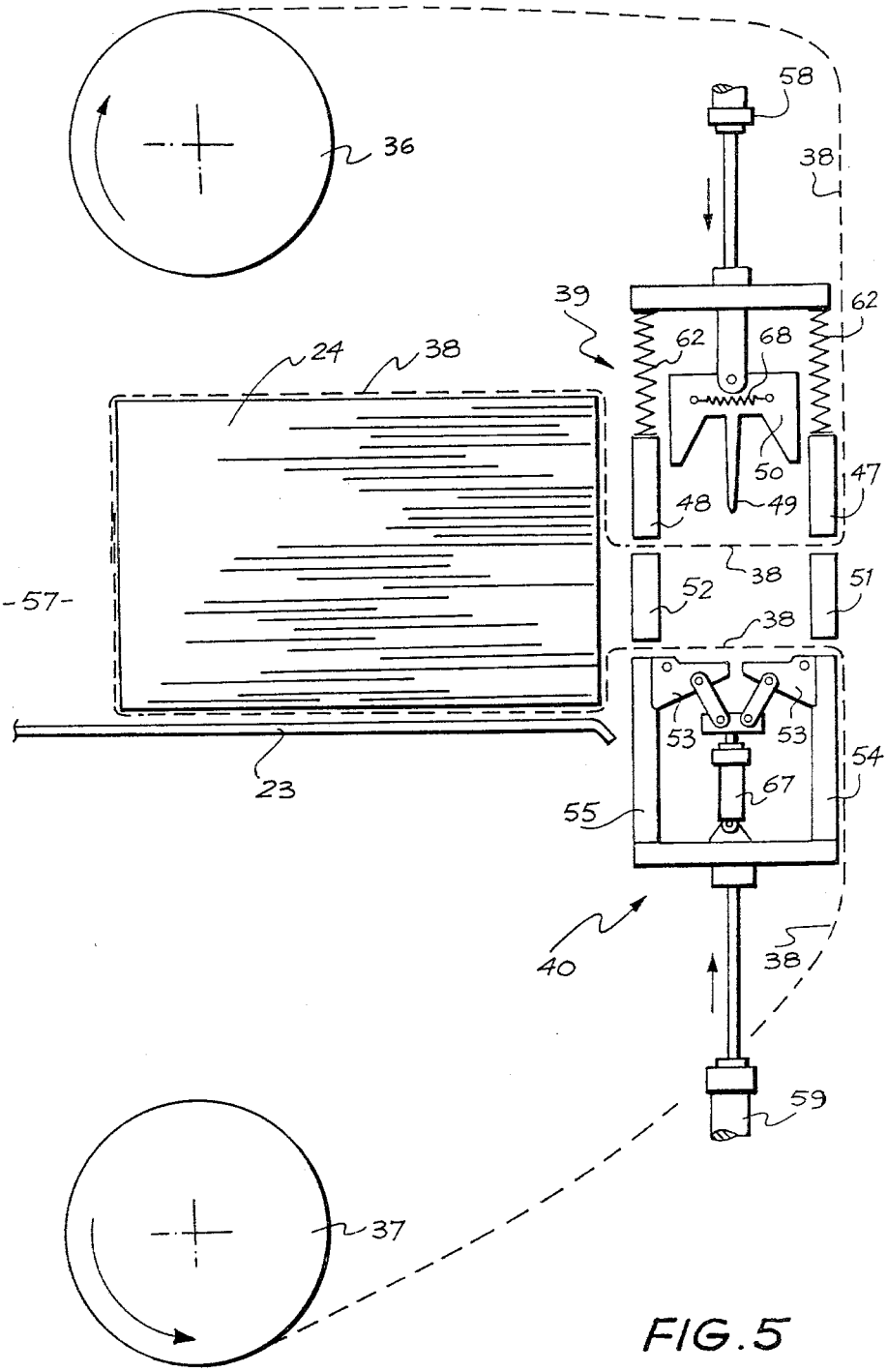

Referring now to FIG. 5 of the drawings. As the bundle 24 is pushed into the strapping machine it contacts and carries forward that portion of the strap 38 which was previously located ahead of the machine. This results in the strap being caused to embrace a portion of the periphery of the bundle, and the strapping length required to embrace the bundle is automatically fed from the two spools 36 and 37 into the bundle support zone 57 of the machine.

When the bundle 24 is located in the support zone 57, the upper head 39 is moved downwardly by a first ram 58, the lower head 40 is moved upwardly by a second ram 59, and the second clamp element 52 is displaced laterally simultaneously by a lever mechanism (which is hereinafter described) to locate in position behind the bundle 24. This arrangement is shown in greater detail in FIG. 6.

Figure 6:
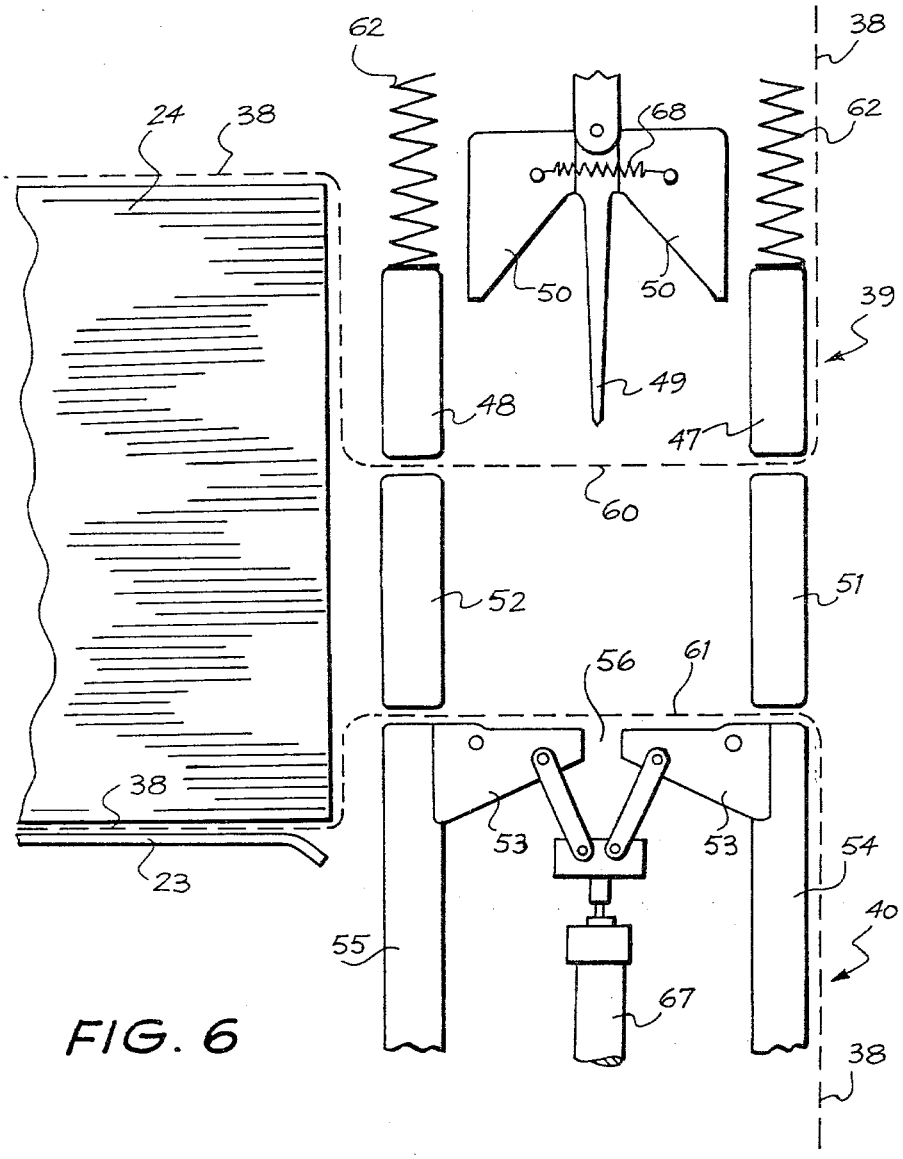

Thus, as shown in FIG. 6, first and second limbs 60 and 61 of the strap 38 are each clamped at two spaced-apart clamping zones. The first limb 60 is clamped between the elements 47, 51 and between elements 48, 52. Similarly, the second limb is clamped between elements 51, 54 and between elements 52, 55. Clamping of the strap 38 in this manner causes it to be drawn tightly about the bundle 24.

After clamping of each limb of the strap 38 at the two zones, the severing blade 49, together with two heater bars 50, is driven downwardly. This downward drive is achieved by continuing downward movement of the first rame 58 against compression springs 62. The compression springs are provided to permit continued travel of the severing blade 49 after the clamping elements 47, 48 have engaged with the elements 51, 52.

Figure 7:
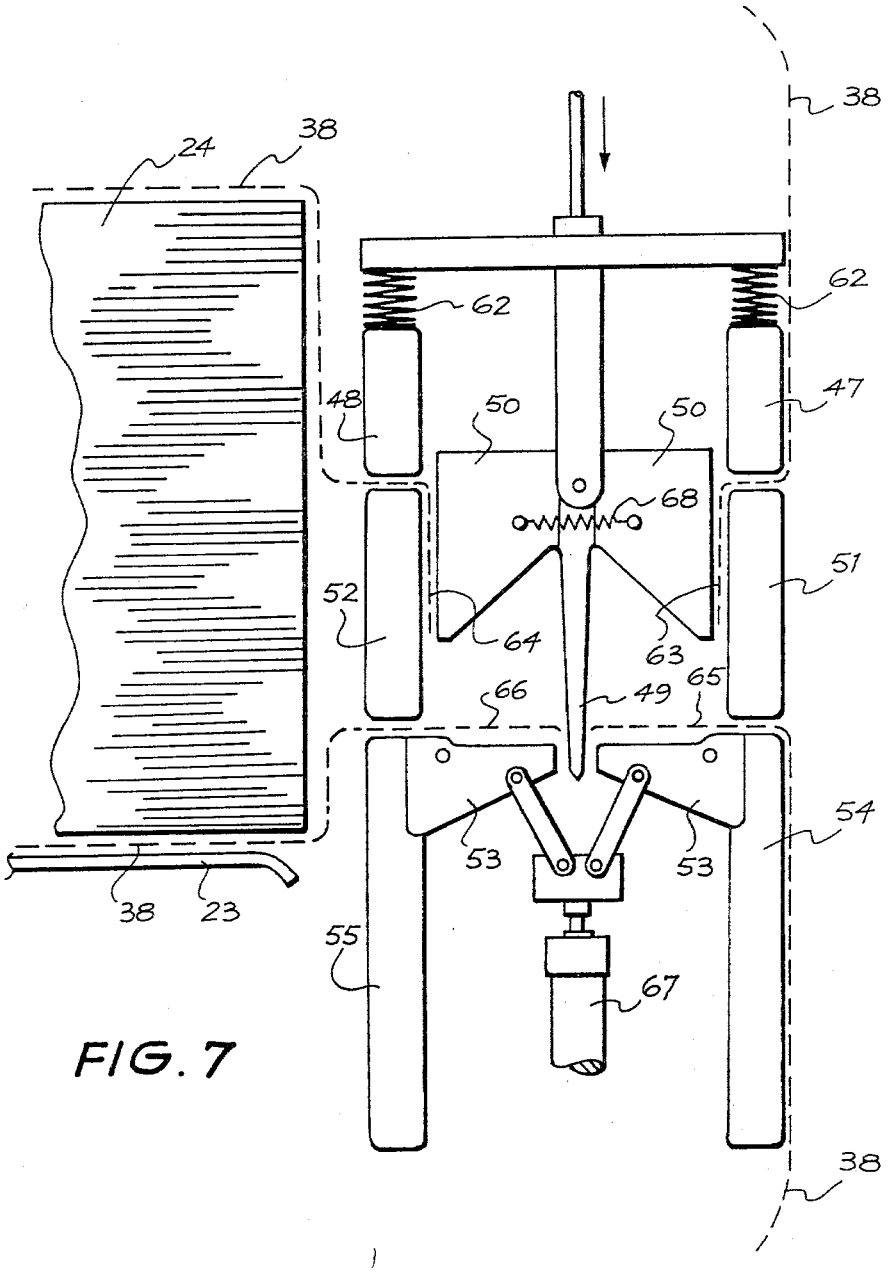

The severing blade 49 is driven through and cuts the two limbs 60 and 61 of the strap 38, resulting in the creation of strap end portions 63, 64 in limb 60 and portions 65, 66 in limb 61, as shown in FIG. 7. As is also shown in FIG. 7, the severed end portions 63 and 64 are driven outwardly by the heater bars 50 to contact the clamp elements 51 and 52 respectively.

Figure 8:
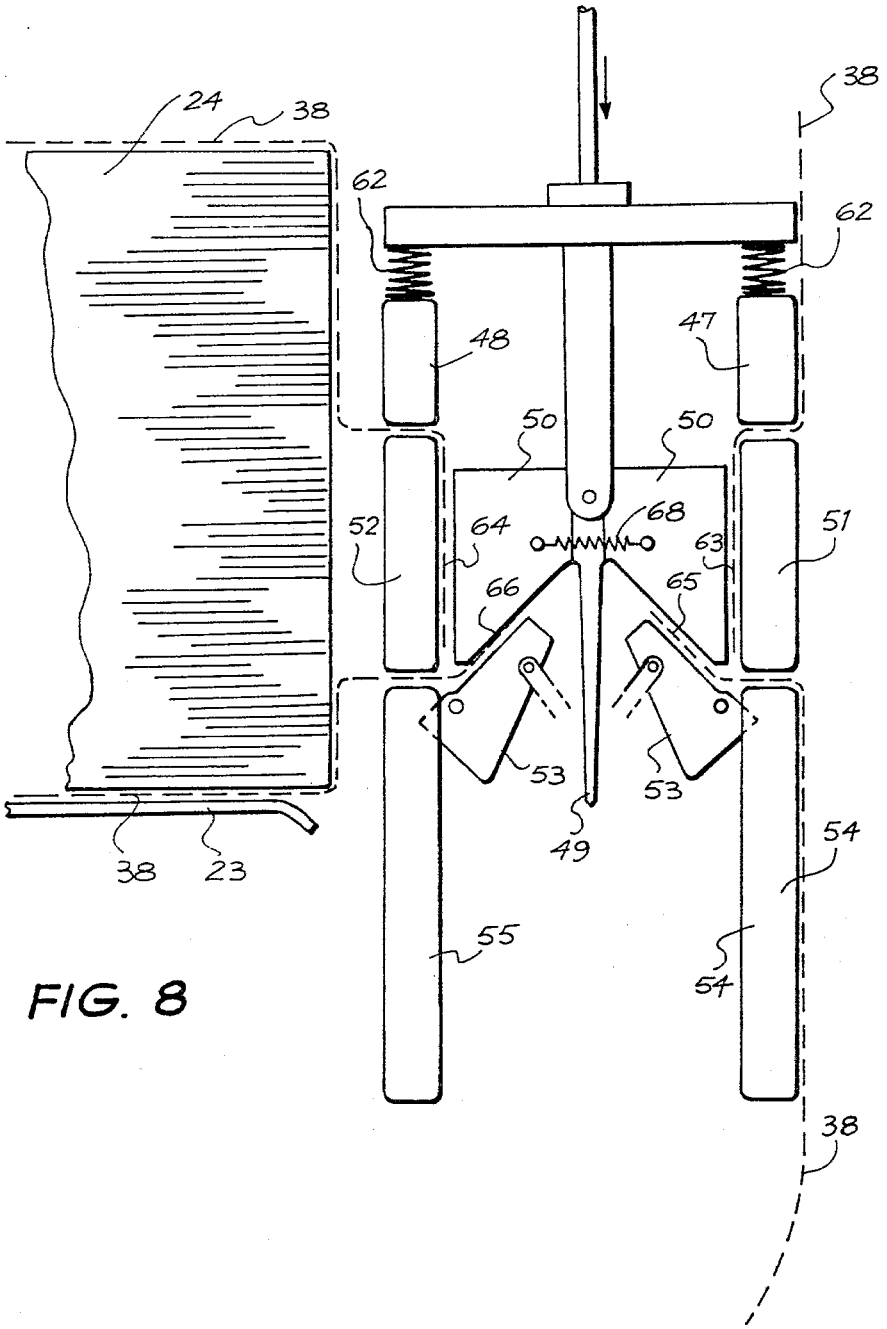

Then, as is shown in the transition from FIG. 7 to FIG. 8, the pivotable fingers 53 are pivoted upwardly by a third ram 67 to drive the severed end portions 65 and 66 of the strap into contact with the heater bars 50. The pivotal motion of the fingers 53 also forces the heater bars 50 outwardly against tension exerted by a spring 68 and into contact with the end portions 63 and 64 of the strap. During this stage the end portions 63 to 66 of the strap are heat softened preparatory to being clamped in heat sealing (welding) contact. Electrical heating elements (not shown) are located within the heater bars 50 and are permanently connected to an electrical supply for this purpose.

Figure 9:
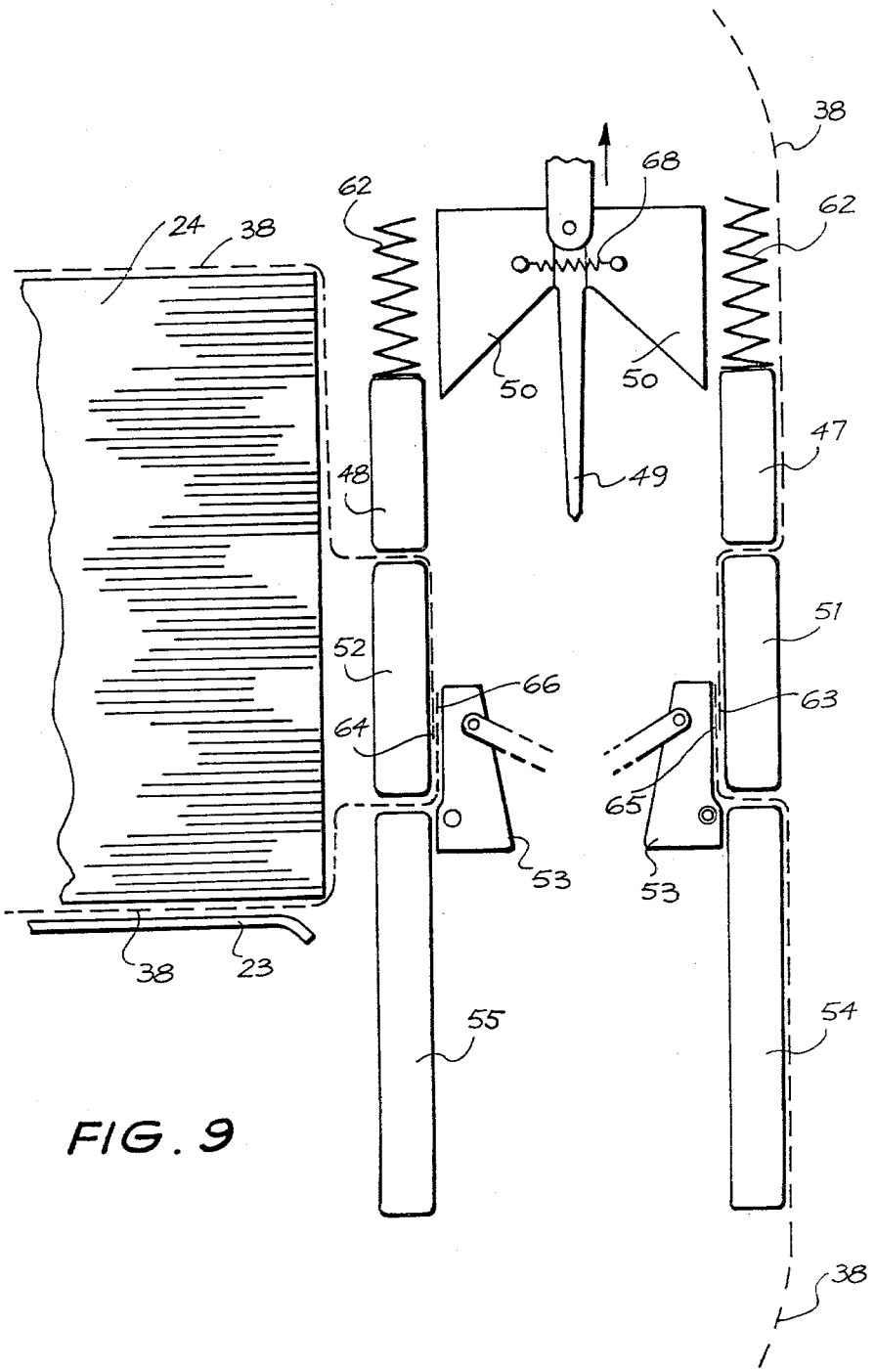
Figure 10:
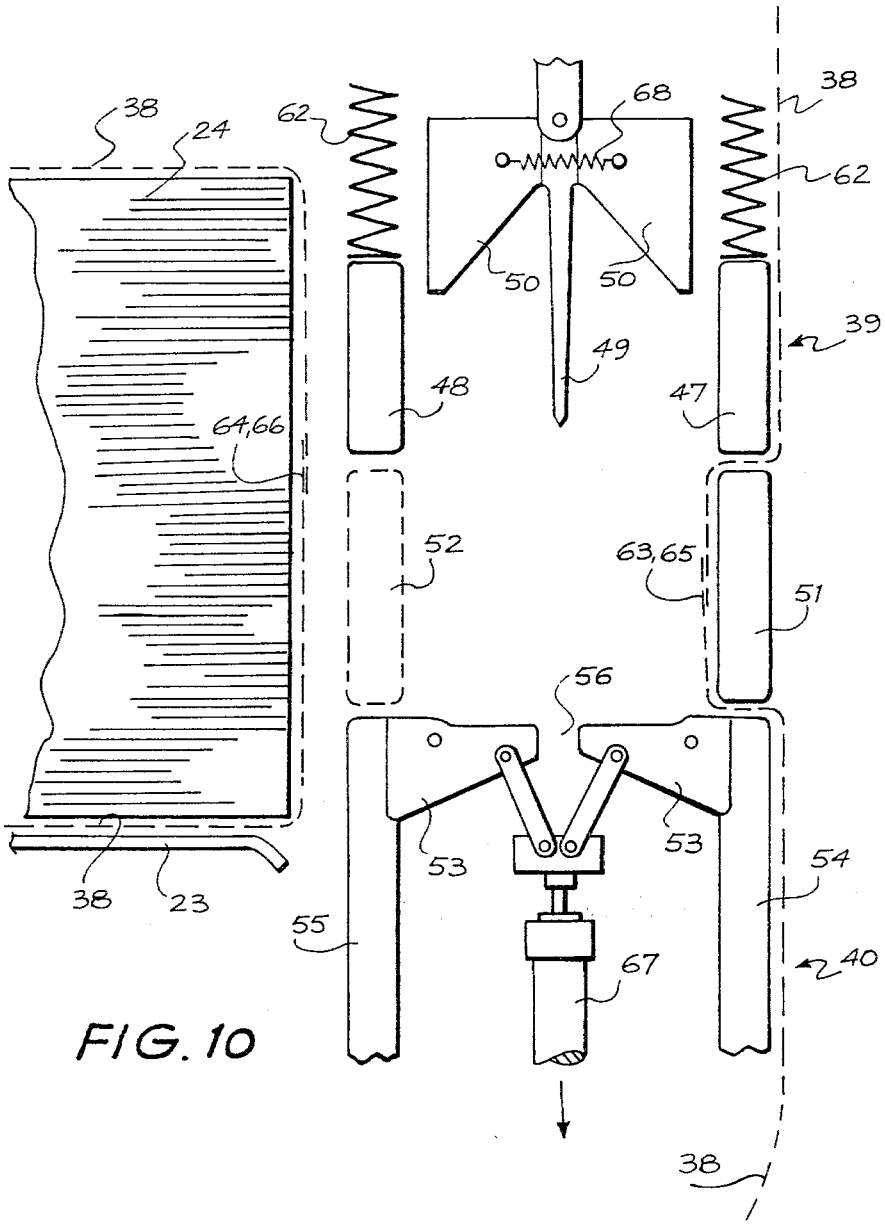
Figure 11:
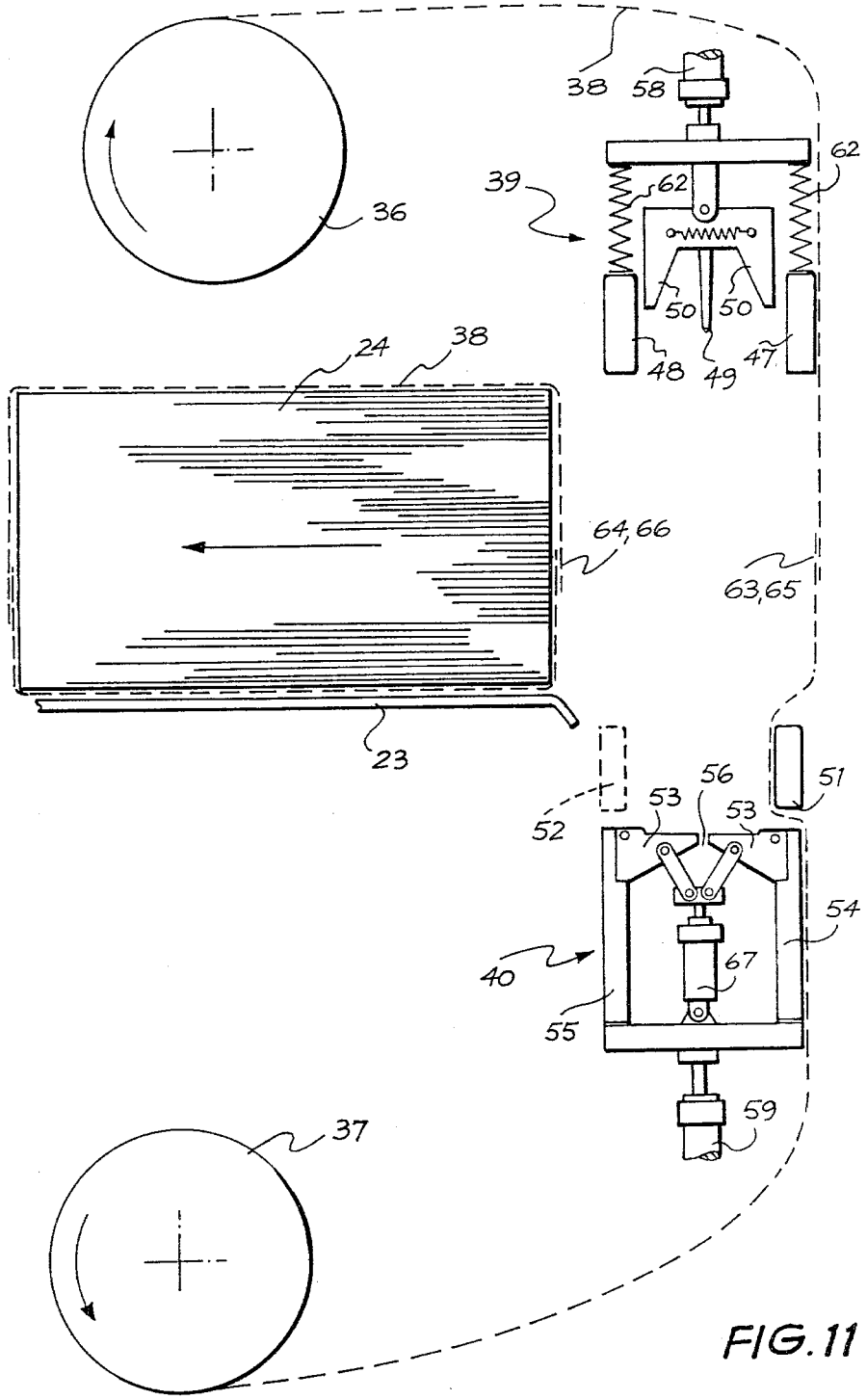

The actual heat sealing or welding operation is shown in FIG. 9. Thus, the severing blade 49 and the heater bars 50 are retracted by reverse action of the first ram 58, and the way is cleared for the pivotal fingers 53 to pivot the end portion 65 and 66 of the strap into clamping engagement with the end portions 63 and 64 respectively. This clamping action is effected between the fingers 53 and the clamp elements 51 and 52.

After the heat sealing operation, the third ram 67 retracts the fingers 53 and the second ram 59 then retracts the entire lower head 40. With retraction of the lower head, the clamp element 52 is moved laterally from contact with the tape portion. Retraction of the clamp element 52 results in the bundle being completely embraced by one portion of the strap 38, whilst the remaining portion of the strap again extends between the spools 36 and 37 and down the front face of the machine. This condition is shown in FIG. 9 and, finally, in FIG. 10 which shows the heads 39 and 40 retracted to their initial position and the bundle 24 commencing to move from the machine.

Movement of the bundle from the machine may be effected either by the pusher which initially moved it into the machine or by a draw bar (not shown) located at the exit side of the machine. Alternatively, the strapped bundle may be pushed from the machine by another, incoming, bundle.

During the machine operating stages shown in FIGS. 5 to 10 inclusive, the clamping feet 25 (FIGS. 2 and 3) bear on the bundle 24 to prevent it from moving.

Having described the general principle of construction and operation of the heads 39 and 40, reference is now made to FIGS. 12 to 17 which show the actual constructional arrangements of the two heads.

Figure 12:
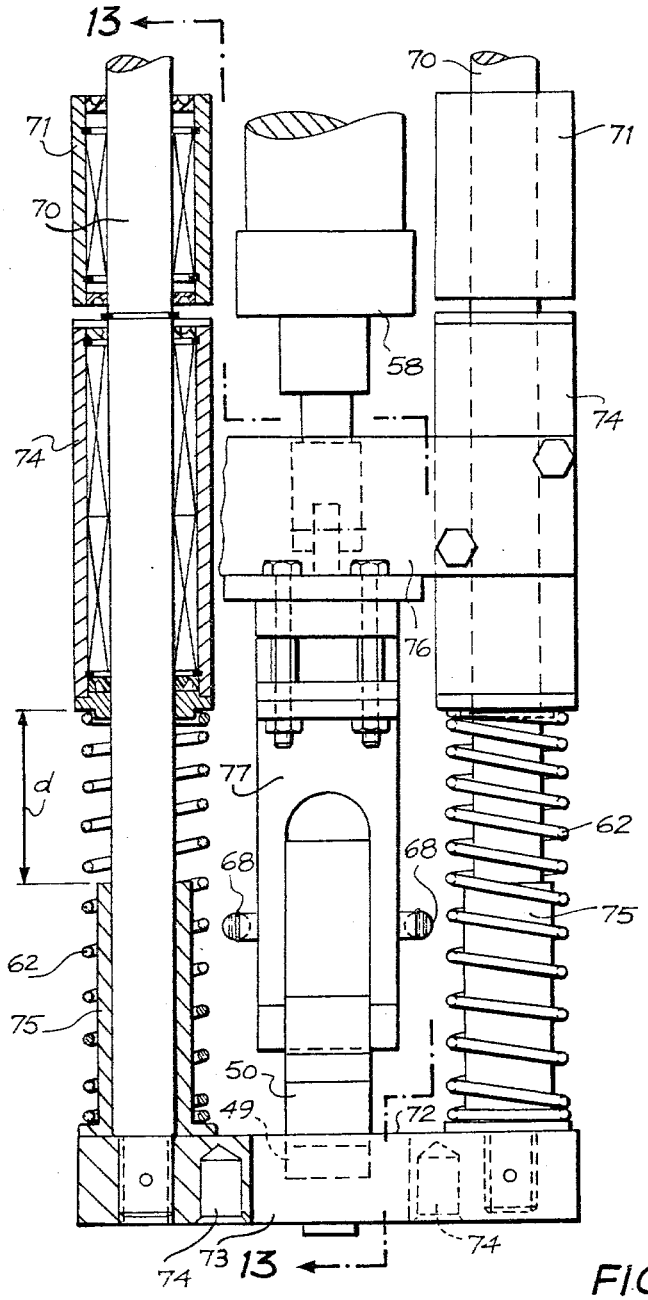
FIG. 12 shows a front elevation view of the top head assembly, as viewed in the direction of the arrow designated by numeral 12 in FIGS. 2 and 3.
Figure 13:
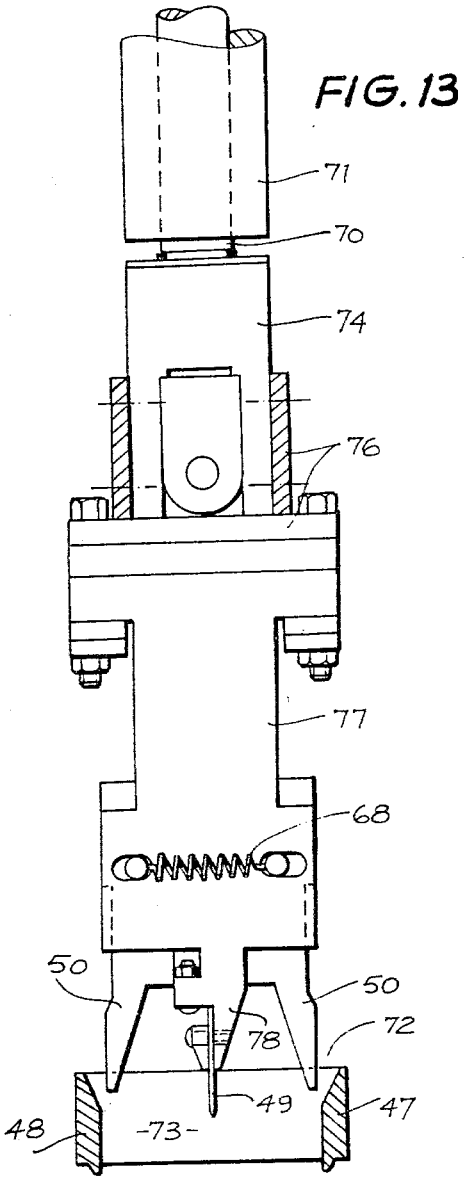
FIG. 13 shows a side elevation view of the top head assembly, as viewed in the direction of the section 13—13 indicated in FIG. 12.
Figure 14:
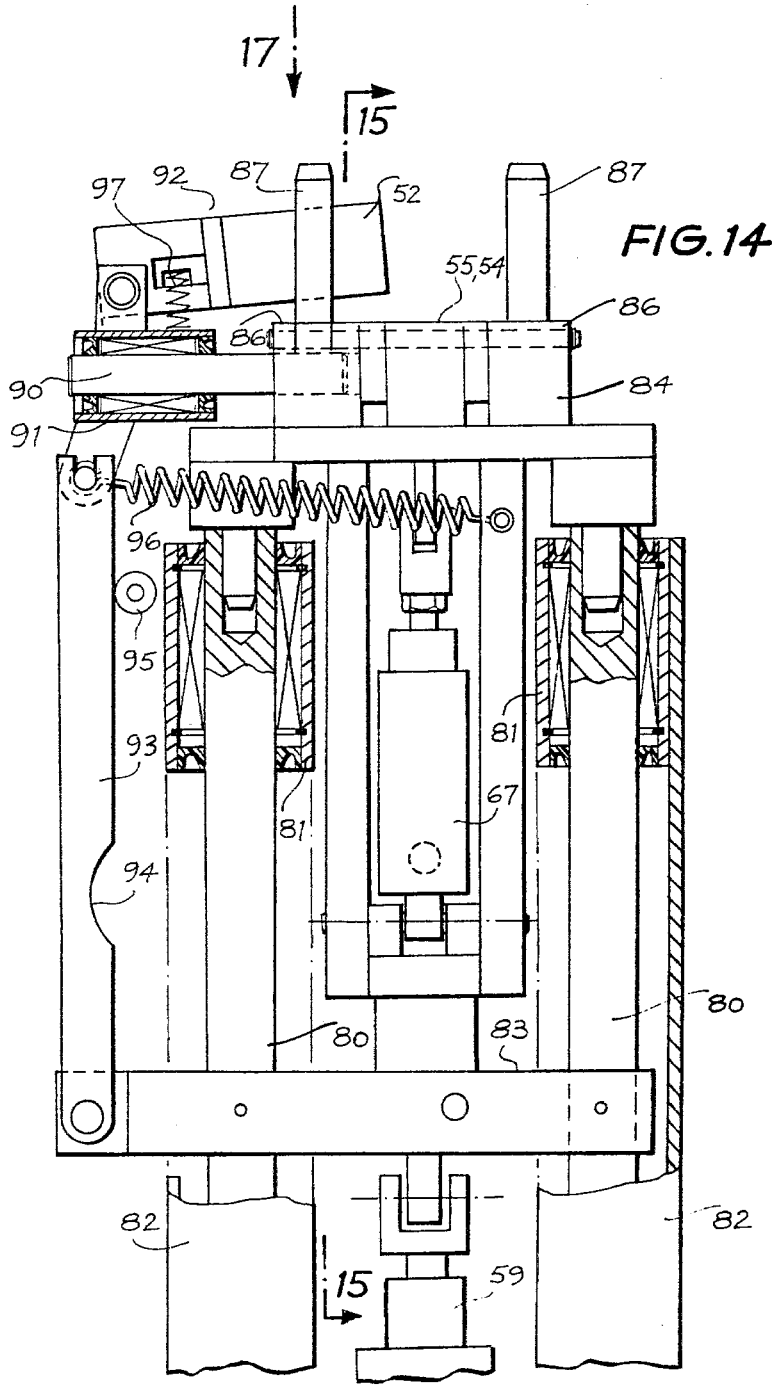
FIG. 14 shows a front elevation view of the lower head assembly, as viewed in the direction of the arrow designated by numeral 14 in FIG. 2.
Figure 15:
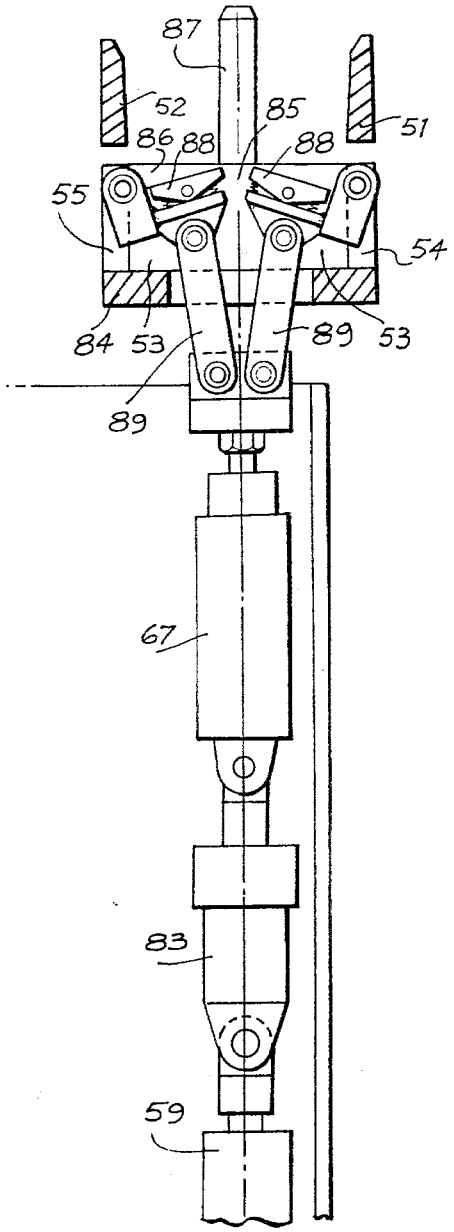
FIG. 15 shows a side elevation view of the lower head assembly, as viewed in the direction of section plane 15—15 of FIG. 14.
Figure 16:
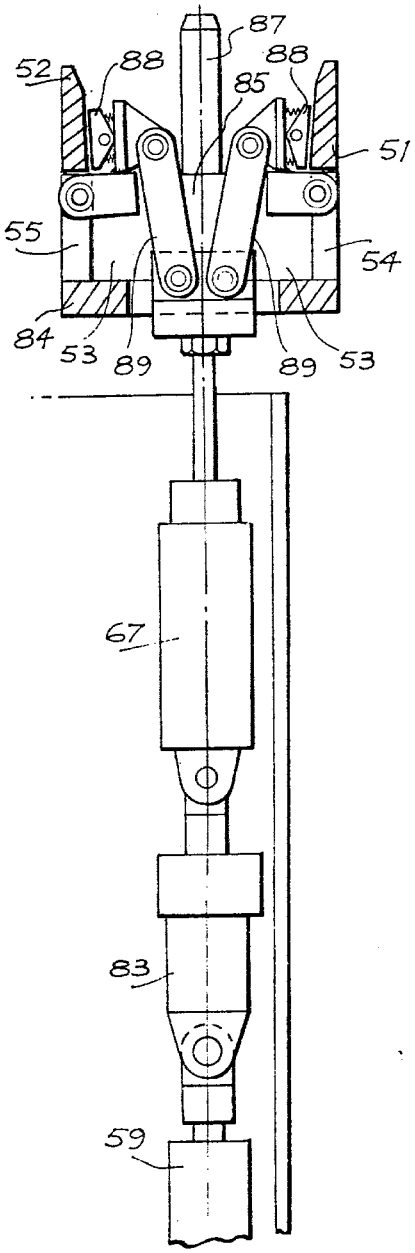
FIG. 16 shows the upper portion of the view shown in FIG. 15, with finger portions of the lower head assembly being shown pivoted to an operational position.

Referring firstly to the upper head 39, as shown in FIGS. 12 and 13. This includes two shafts 70 which are carried in upper linear bearings 71. The upper bearings 71 are connected with the upper sub-frame 21 and provide for rectilinear movement (up and down) of the shafts 70.

Bridging the lower end of both of the shafts 70 is a foot 72, the foot having a central rectangular cavity 73 and two side walls which constitute the clamping elements 47 and 48 referred to previously. End walls of the foot include locating sockets 74 for receiving locating dowels associated with the lower head assembly 40.

A lower linear bearing 74 is mounted to and is slidable relative to each of the shafts 70. However, the sliding movement of each of the bearings 74 is restricted to distance d, as shown in FIG. 12, by end-stop bushes 75. The bushes 75 each bear on the foot 72, and helical compression springs 62 are interposed between the foot and each of the lower linear bearings 74. The compression springs 62 as shown in FIG. 12 correspond with the springs having the same reference numeral shown in the more schematic FIGS. 4 to 11.

The two lower linear bearings 74 are interconnected by a bridging element 76, and the bridging element carries a casting 77 which supports the severing blade 49 and heater bars 50 as previously referred to. The severing blade is fixed to the casting 77 by a screw mounted fixing block 78, so that it may be replaced conveniently, and the heater bars 50 are pivotably mounted to the casting 77 and spring biased towards one another by the tension spring 68.

The first ram 58 (referred to previously with reference to FIGS. 4 to 10 and shown also in FIG. 12) connects between the upper sub-frame 21 and the bridging element 77. When the ram is extended the entire upper head, including the shafts 70, the foot 72 and the bridging element 76, is moved downwardly until such time as the foot 72 contacts the lower head assembly 40. This condition has been described previously with reference to FIGS. 4 to 6.

Thereafter, following contact between the foot 72 and the lower head assembly, continued downward movement of the ram 58 causes the bearings 74 to move along the shafts 70 for the distance d, against the thrust exerted by the compression springs 62. This movement of the bearings 74, and the bridging element 76 connected thereto, causes the severing blade 49 and the heater bars 50 to project through the aperture 73 in the foot. This condition is that which has been described previously with reference to FIGS. 7 and 8 of the drawings.

After the clamping/severing/sealing operation, the ram 58 retracts and the upper head is restored to the condition shown in FIG. 12.

Reference is now made to FIGS. 14 to 17 which show details of the lower head assembly 40.

This includes two shafts 80 which are movable, up and down, within linear bearings 81 and 82, the bearings being mounted to the lower sub-frame 22 of the strapping machine. The shafts 80 are bridged by a connecting element 83, so that they are moved in unison, and the bridging element is connected to the lower sub-frame by way of the second ram 59. This ram has been referred to previously in the context of FIGS. 4 to 11.

The upper ends of the shafts 80 are connected by a bridging block 84 which incorporates a recess 85, end walls 86 and side walls 54 and 55. The side walls 54 and 55 constitute the third and fourth clamping elements which have been referred to in the context of FIGS. 4 to 11 and which carry the same reference numerals.

Dowels 87 are provided on the bridging block 84 for engagement in the locating sockets 74 of the upper head 39, when the heads are moved into engagement.

Hinge mounted within the recess 85 of the bridging block 84 are the two pivotal fingers 53 which have been referred to previously. These fingers include spring-loaded rocker pads 88, which provide for any misalignment of the heater bars 50 of the upper head 39, and the fingers are connected by links 89 to the upper end of the third ram 67. This (third) ram has been referred to in the context of FIGS. 4 to 11 and it connects, at its lower end, to the connecting element 83. Actuation of the ram 67 causes the fingers 53 to pivot upwardly and outwardly, firstly so that they drive the binding strap 38 into contact with the heater bars 50, as shown in FIG. 8, and secondly so that they drive the banding strap 38 into contact with the clamping elements 51 and 52, as shown in FIG. 9. This second condition is shown also in FIG. 16.

A slide shaft 90 extends outwardly from the bridging block 84 in a lateral direction and this carries a linear motion bearing 91. A generally U-shaped element 92 is pivotably mounted to the upper side of the bearing 91, and a pivot arm 93 is pivotably mounted to the underside of the bearing 91.

The pivot arm 93 is connected adjacent its upper end to bearing 91 and is pivotably connected at its lower end to the connecting element 83. Also, the pivot arm 93 includes a cam surface 94 part way along its length, the cam surface 94 being engageable with a cylindrical cam follower 95 which is mounted to the lower sub-frame 22. A tension spring 96 biases the pivot arm 93 into permanent contact with the cam follower 95.

When the lower head assembly (including the connecting element 83, bridging block 84 and pivot arm 93) is moved upwardly by the ram 59 toward the upper head 39, the bearing 91 moves to the right (as viewed in FIG. 14) when the cam follower 95 rides into the cam surface 94. This then moves the entire U-shaped element 92 to the right.

Figure 17:
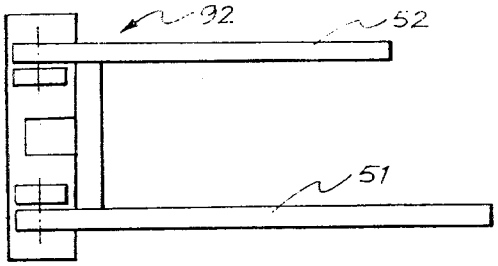
FIG. 17 shows a plan view of a clamping element of the lower head assembly, as viewed in the direction of the arrow designated by numeral 17 in FIG. 15, and FIGS. 18 and 19 respectively show pneumatic and electrical control circuits which form a part of the machine shown in FIGS. 2 and 3 and as used to control the steps illustrated in FIGS. 4 to 11.

The U-shaped element 92 has two limbs which constitute the first and second clamp elements 51 and 52 previously referred to. The limb 51 has a length such that is always projects across the centre-line of the lower head, and the limb 52 has a (shorter) length such that is projects across the centre-line of the lower head only when the bearing 91 moves to the right. The difference in length of the limbs 51 and 52 is shown in FIG. 17, and it is the shorter length of limb 52 which enables it to be moved laterally into and out of line with the tape 38 as described with reference to FIGS. 4 to 11. The limb 51 is always located across the line of the tape and, for all practical purposes, it may be regarded as a "fixed" limb or clamp element.

The limbs (or clamp element) 51 and 52 are normally biased out of contact from the bridging block walls (or clamping elements) 54 and 55 by a compression spring 97, but the respective clamp elements are forced toward one another, against the spring loading, when the upper and lower heads are brought into engagement by actuation of the second ram 59.

Figure 18:
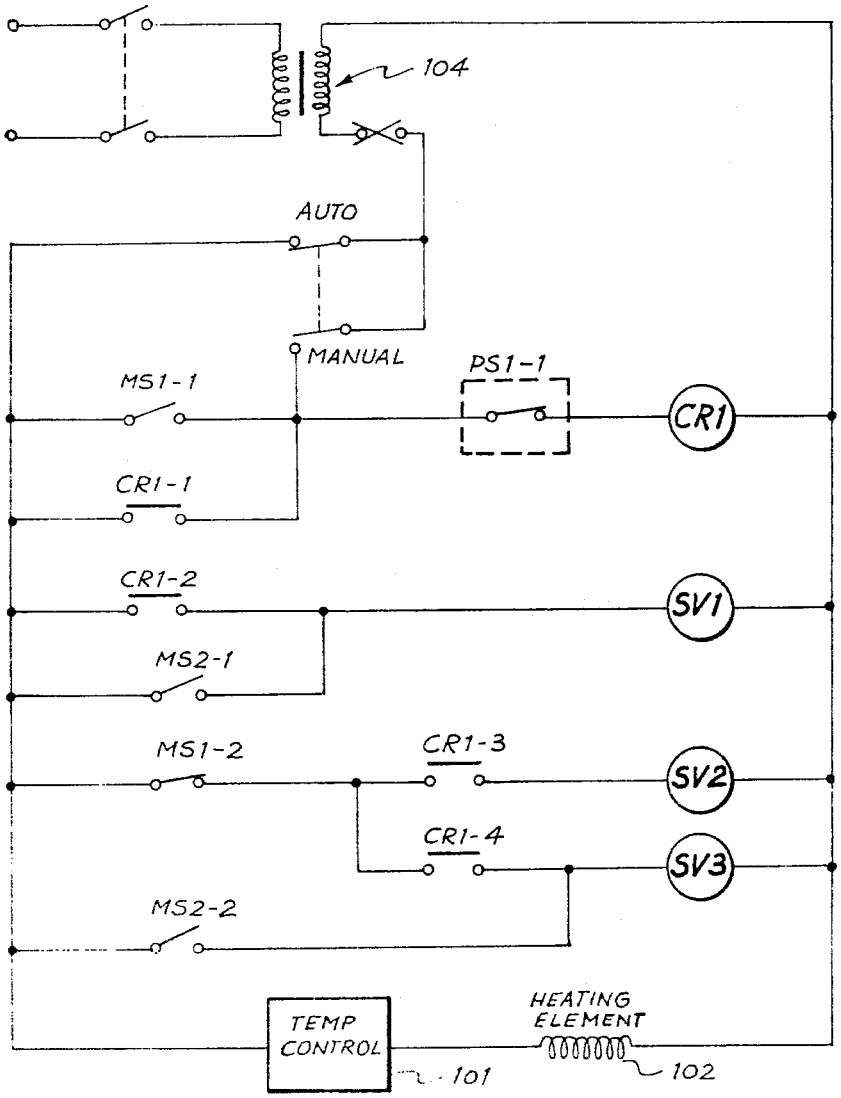
Figure 19:
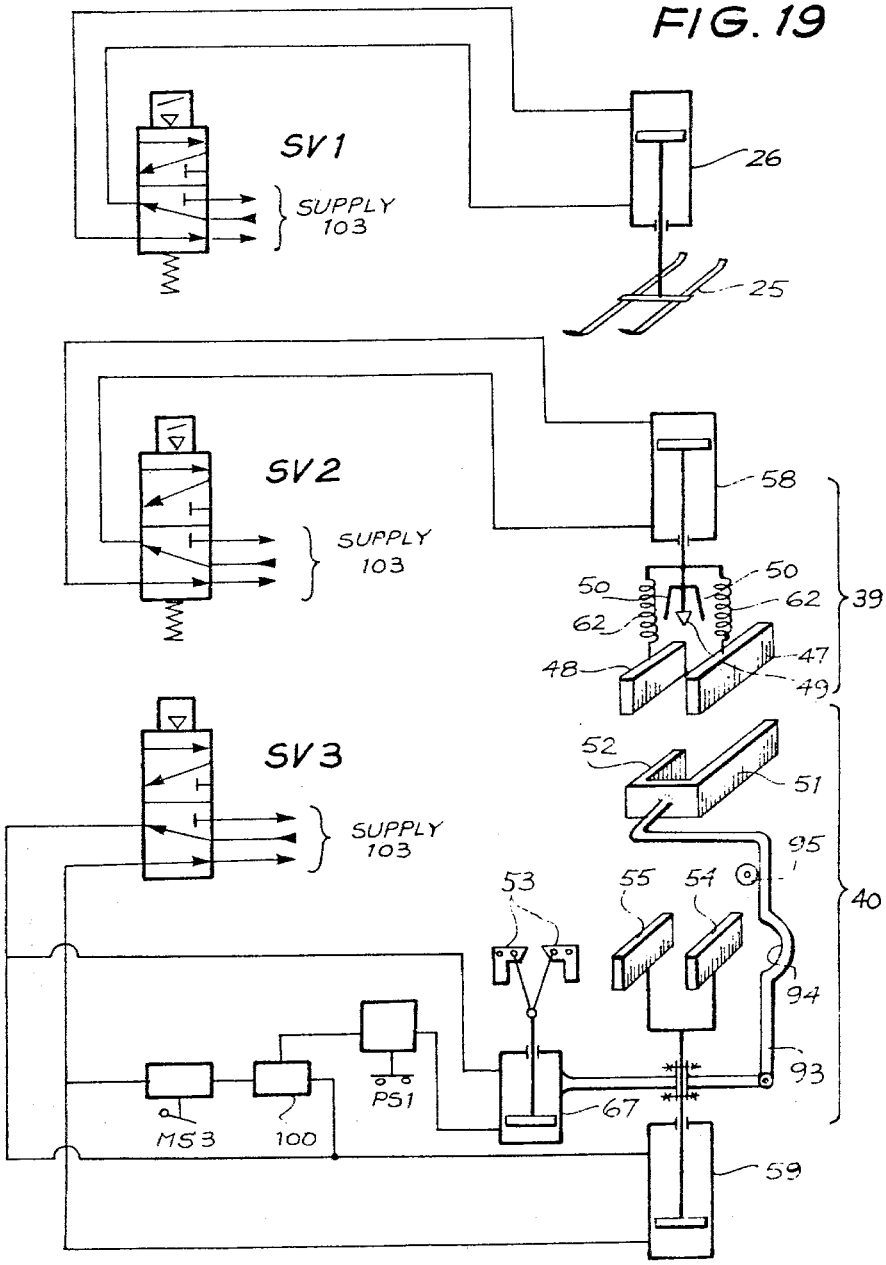

Pneumatic and electrical control circuits for the system above described are shown in FIGS. 18 and 19, which are now referred to.

Assuming that the machine is set for automatic (Auto) control (see FIG. 18), as the bundle enters the machine it operates a microswitch MS1. This causes normally open contact MS1-1 to close and causes normally closed contact MS1-2 to open.

Closing of contact MS1-1 causes energization of a control relay CR1 and consequential closure of the normally open relay contacts CR1-1 to CR1-4. Closing of contact CR1-1 (i.e. a latching contact) results in the control relay CR1 being maintained in an energized state even after the bundle has passed the microswitch MS1 and its contact MS1-1 has opened again.

Closing of contact CR1-2 results in energization of a solenoid valve SV1 and actuation of the ram 26. Such actuation causes lowering of the clamping feet 25 onto the bundle.

When the bundle has passed the microswitch MS1 and is located within the machine, contact MS1-1 opens and contact MS1-2 closes. With closing of contact MS1-2, solenoid valves SV2 and SV3 are energized via contacts CR1-3 and CR1-4. These latter contacts are retained closed due to the relay CR1 being energized via the latching contact CR1-1.

With energization of the solenoid valves SV2 and SV3, the first and second rams 58 and 59 are actuated. Actuation of these rams causes closing of the upper and lower heads 39 and 40, clamping of the tape and, subsequently, severing of the tape as previously described.

At a point during the closing movement of the upper head 39, a microswitch MS2 is operated to cause closing of its normally open contacts MS2-1 and MS2-2. Closing of these contacts results in the energization of the solenoid valves SV1 and SV3 being sustained even after the control relay CR1 is de-energized.

Also during closing of the heads 39 and 40, the clamp elements 51 and 52 are displaced by way of the mechanical lever arm 93 so that the clamp element 52 is moved laterally into the position shown in FIGS. 5 to 9.

When the first ram 58 is completing its travel and the severing operation is performed on the tape, as previously described, a pneumatic microswitch MS3 (FIG. 19) is closed to cause actuation of the third ram 67 and welding of the strap end portions as hereinbefore described with reference to FIGS. 8 and 9. Actuation of the fingers 53 during this stage of the operation is controlled by the third ram 67 in conjunction with a detent direction change valve 100.

A pressure operated switch PS1 is located in circuit with the ram 67 and has a normally closed electrical contract PS1-1 located in circuit with the control relay CR1. This switch PS1 is set to operate (and open contact PS1-1) when full pressure is applied by the ram 67, as a result of the fingers being pivoted into their maximum position as shown in FIG. 9.

When contact PS1-1 is opened, the control relay CR1 is de-energized and solenoid valve SV2 is also de-energized, resulting in retraction of the upper head 39. However, the clamping foot 25 and the lower head 40 are both retained in position temporarily, as a result of contacts MS2-1 and MS2-2 remaining closed.

When the upper head 39 has been retracted by a predetermined amount, the microswitch MS2 is disengaged and contacts MS2-1 and MS2-2 open to cause de-energization of the solonoid valves SV1 and SV3. Then, the clamping foot 25 and the lower head 40 are retracted to their starting position. The upper head 39 being also retracted to its starting position, the entire sequence of events can be reinitiated by entry into the machine of a further bundle.

The heater bars 50 are permanently heated by way of a temperature control device 101 and inbuilt heating element 102.

The pneumatic circuit of FIG. 19 is energized from a pressurized air supply 103, and the electric circuit of FIG. 18 is energized from a transformer coupled electric main supply 104.

Manual (Man.) operation of the system is similar to the automatic operation as above described and differences of operation will be apparent from a study made of the circuit diagram of FIG. 18.

Variations and modifications may be made in respect of the above described embodiment without departing from the scope of the invention. For example, whilst the invention has been described in the context of a machine having only one upper and one lower head, it is to be understood that the machine may incorporate parallel multi-head arrangements for effecting multi-strapping of a single bundle or simultaneous strapping of a plurality of bundles. With such an arrangement the further upper and lower heads would be mounted to their own, separate, sub-frames and each of the upper and lower sub-frames would then be mounted to the main frame via support shafts. However, it will be understood that separate lead screws would be provided for the separate upon and lower sub-frames so that each upper and lower pair of subframes might be independently positioned between the side walls of the main frame.

I claim:

1. An apparatus for strapping an article with heat sealable plastics material strap, the apparatus comprising:

(a) spaced-apart first and second strap stations arranged to support opposite ends of the strap, one at least of said stations being a strap feed station, (b) support means for receiving and supporting the article to be strapped and disposed such that, in operation of the apparatus, the strap embraces a portion of the periphery of the article when supported upon the support means with first and second limbs of the strap extending toward the first and second stations respectively, and (c) first and second heads and means for driving said heads toward and away from one another, the first head comprising spaced-apart clamp elements, heater bars located between the clamp elements and a severing means located intermediate the heater bars, means for driving the heater bars and the severing means in a direction parallel to the direction of movement of the first head and relative to the clamp elements, the second head also comprising a plurality of clamp elements including a first set of spaced-apart clamp elements which are arrayed with the clamp elements of the first head and which are co-operable with the clamp elements of the first head to clamp the first limb of the strap at spaced apart zones, and a second set of spaced apart clamp elements which are arrayed and cooperable with the first set of clamp elements of said second head to clamp the second limb of the strap at spaced-apart zones, the severing means being actuable in operation of the apparatus to sever both the first and the second limbs of the strap at a region between said spaced-apart zones, and the second head further comprising means for displacing end portions of the second limb when severed into contact with the heater bars and thereafter into overlapping heat sealing contact with corresponding end portions of the severed first limb.

2. An apparatus for strapping an article with a heat sealable plastics material strap, the apparatus comprising:

(a) spaced-apart first and second strap stations arranged to support opposite ends of the strap, one at least of said stations being a strap feed station, (b) support means for receiving and supporting the article to be strapped and disposed such that, in operation of the apparatus, the strap embraces a portion of the periphery of the article when supported upon the support means with first and second limbs of the strap extending toward the first and second stations respectively, and (c) first and second heads and means for driving said heads towards and away from one another, the first head comprising first and second spaced-apart clamp elements, two spaced-apart heater bars located between said elements and a severing means located intermediate the heater bars, means for driving the heater bars and the severing means in a direction parallel the direction of movement of the head and relative to the clamp elements, the second head comprising first, second, third and fourth clamp elements, the first and third of said clamp elements being arrayed with each other and with the first clamp element of the first head, and the second and fourth said clamp elements being arrayed with each other and with the second clamp element of the first head, said second clamp element of the second head being laterally displaceable, the first and second clamp elements of the first head being co-operable with the first and second clamp elements respectively of the second head to clamp the first limb of the strap at spaced-apart zones, and the first and second clamp elements of the second head being co-operable with the third and fourth clamp elements respectively of the second head to clamp the second limb of the strap at spaced-apart zones, the severing means being actuable in operation of the apparatus to sever both the first and second limbs of the straps at a region between said spaced-apart zones, and the second head further comprising means for displacing end portions of the second limb when severed into contact with the heater bars and thereafter into overlapping heat sealing contact with corresponding end portions of the severed first limb.

3. The apparatus as claimed in claim 2, wherein the displacing means in the second head comprises first and second fingers which are pivotable with respect to the third and fourth clamp elements respectively, the fingers when pivoted being engageable with the heater bars of the first head when said heater bars are extended between the clamp elements of the second head and being engageable with the first and second clamp elements of the second head when the heater bars are not so extended.

4. The apparatus as claimed in claim 2, wherein the first and second heads are respectively actuable by first and second fluid operated rams and wherein the pivotable fingers are actuable by a third fluid operated ram.

5. The apparatus as claimed in claim 4, wherein the severing means and the heater bars are coupled to the first ram and wherein the first and second clamp elements of the first head are coupled to the first ram by way of compression springs, whereby the severing means and the heater bar may be moved a greater longitudinal distance toward the second head than the first and second clamp elements of the first head, with the difference in the distance travelled being accommodated by compression of the springs.

6. The apparatus as claimed in claim 2, wherein the second clamp element of the second head is movable in a lateral direction by a lever arm which engages a cam follower and which is cammed to pivot during movement of the second head toward the first head.

7. The apparatus as claimed in claim 2 and including a said strap extending between the strap stations, the strap passing between the first clamp element of both the first and the second heads and then between the first and third clamp elements of the second head in its passage between the stations.

8. The apparatus as claimed in claim 2, wherein the first and second heads are mounted to first and second sub-frames respectively, and wherein the sub-frames are mounted to a main frame and are movable in unison with respect to the width of the main frame.

9. The apparatus as claimed in claim 2, and including two or more pairs of said first and second heads, each pair of heads being mounted to an associated pair of sub-frames, the plurality of sub-frames being mounted to a main frame and each pair of sub-frames being movable in unison with respect to and independently of the other(s).

10. The apparatus as claimed in claim 2 and including a clamping foot which is actuable to clamp a said article to the said support means of the apparatus during a strapping operation of the apparatus.

* * * * *